US006345911B1

(12) United States Patent
Young et al.

(10) Patent No.: US 6,345,911 B1
(45) Date of Patent: Feb. 12, 2002

(54) LOCK TOP CANISTER BAG AND METHOD OF MANUFACTURE

(75) Inventors: Daniel L. Young; Clarence A. Cassidy, both of Escondido, CA (US)

(73) Assignee: American Innotek, Inc., Escondido, CA (US)

( * ) Notice: Subject to any disclaimer, the term of this patent is extended or adjusted under 35 U.S.C. 154(b) by 0 days.

(21) Appl. No.: 09/588,275

(22) Filed: Jun. 6, 2000

(51) Int. Cl.[7] ..... B65D 33/02; B65D 33/10; B65D 33/24

(52) U.S. Cl. ..... 383/6; 4/144.2; 4/484; 383/15; 383/34; 383/44; 383/63; 383/104; 383/906

(58) Field of Search ..... 383/33, 34, 104, 383/906, 6, 15, 44, 63, 65; 4/144.2, 484

(56) References Cited

U.S. PATENT DOCUMENTS 3,226,787 A * 1/1966 Ausnit ..... 383/63
3,282,493 A * 11/1966 Kamins et al. ..... 383/15
3,559,873 A * 2/1971 Hart ..... 383/15
4,848,930 A * 7/1989 Williams et al. ..... 383/104
5,116,139 A 5/1992 Young et al.
5,354,132 A 10/1994 Young et al.
5,531,724 A 7/1996 Young et al.
D382,055 S 8/1997 Cassidy et al.
5,749,658 A * 5/1998 Kettner ..... 383/63
5,782,562 A * 7/1998 Anspacher ..... 383/15
5,839,831 A * 11/1998 Mazzochi ..... 383/65
5,961,501 A 10/1999 Cassidy et al.
6,022,144 A * 2/2000 Hausslein ..... 383/33
6,139,187 A * 10/2000 Galomb et al. ..... 383/34
6,164,821 A * 12/2000 Randall ..... 383/34
6,254,273 B1 * 7/2001 Galomb et al. ..... 383/638

* cited by examiner

*Primary Examiner*—Stephen P. Garbe
(74) *Attorney, Agent, or Firm*—Brown, Martin, Haller & McClain LLP

(57) ABSTRACT

A bag of flexible material has a pair of opposing flat stiffener strips of stiffer material than the bag extending from the open end of the bag. The strips are joined together at least at one end. A closure device is formed on the inner face of each strip for releasably closing the open end of the bag. A handle flap extends upwardly from the upper edge of the strips at least at the one, joined end of the strips, and is integrally formed with the strips. A fold line joins the handle flap to the strips. The bag can be held open by urging opposite ends of the strips towards each other, and the handle flap can be bent downwardly about the fold line to secure the bag in an open condition.

15 Claims, 4 Drawing Sheets

FIG.11A EXTRUDE DUAL LOCK TOP RIBBONS

FIG.11B DIE CUT EDGE

ATTACH EACH RIBBON TO CONTINUOUS FILM SHEETING

PLACE TWO OPPOSING DIE CUT SHEETS TOGETHER AND SEAL INTO INDIVIDUAL BAGS

FOLD GUSSET INSIDE TO CLOSE END OF BAG

FIG. 11C PERFORATED CUT EDGE

LOCK TOP CANISTER BAG AND METHOD OF MANUFACTURE

BACKGROUND OF THE INVENTION

The present invention relates generally to containers in the form of flexible bags having an open end with a releasable closure, and is particularly concerned with canister bags suitable for holding various household products such as flour, sugar, cake mixes, and the like, as well as for bags for storage and disposal of waste products.

Various household products for cooking and the like are conventionally sealed in a flexible bag which may be placed in an outer cardboard container. Such bags can often not be re-sealed after opening, making it difficult to keep the product fresh and in good condition when the entire contents of the bag are not used at one time. Also, dispensing a measured quantity of product from such bags can be a problem, and spills are a common occurrence.

Another application for flexible bag-like containers is for collection, storage and disposal of body fluids such as urine, blood, vomit, or the like. Such containers are often used when a person is at a location where no convenient bathroom facilities are available, such as while traveling, camping, on outdoor construction sites, or at other outdoor events. A fluid containment bag for this purpose is described, for example, in U.S. Pat. No. 5,116,139 of Young et al. and in application Ser. No. 09/206,616 of Young et al. filed Dec. 7, 1998, now abandoned. It can sometimes be difficult to hold such bags open during use, and it is important that they can be completely sealed to hold the waste products after use.

SUMMARY OF THE INVENTION

It is an object of the present invention to provide a new and improved canister bag suitable for various uses, as well as a new and improved method of manufacturing such a bag.

According to one aspect of the present invention, a lock top canister bag is provided, which comprises a bag of flexible material having a closed end and an open end, and a closure device secured to the open end of the bag for releasably closing the open end, the closure device comprising a pair of opposing flat strips of stiffer material than the bag extending from the open end of the bag, the strips having a lower edge secured to the open end of the bag, an upper edge, and opposite ends, and the strips being joined together at least at one of their ends, and a handle flap extending upwardly from the upper edge of the strips at least at one end of the strips, the handle flap being integrally formed with the strips and having a fold line joining the handle flap to the strips, whereby the bag opening can be reshaped and stabilized by folding the flap downward. This action produces dynamic tensional or hoop stress thereby locking the bag in the open position.

The closure device may comprise opposing zip lock type fastener formations formed in opposing inner portions of the strips. The bag is opened by releasing the closure device, and can be held manually in an open condition by urging opposite ends of the strips towards one another, such that the strips each flex outwardly. If desired, the handle flap can then be bent downwardly outside the strips about the fold line in order to hold the bag in an open condition, without requiring the user to manually hold it open. Upwardly projecting flaps or tabs may be provided at both ends of the bag opening, secured to the remainder of the strips along fold lines. In this case, both flaps may be folded downward through at least 90 degrees, providing dynamic tensioning or hoop stress to lock the bag in an open condition. This can be useful both when the bag contains products to be dispensed, such as cooking or other household products, and when the bag is used for waste disposal.

The handle flap may be designed as a pour spout to allow products to be poured from the bag. A handle flap or tab may be provided at one or both ends of the strips, as noted above. The strips, closure device, and handle flap are preferably formed integrally from one or two extruded ribbons of semi-rigid plastic material which are heat sealed to the open top of a bag.

The bag may have an inwardly folded gusset at its lower end which can be flattened to expand and flatten the lower end of the bag so that it can stand in an open condition on a kitchen counter or the like. If the handle flap is bent downwardly to lock the upper end of the bag open, the user does not have to use either hand to hold the bag open, and can readily spoon or scoop product from the bag while cooking or preparing food, for example.

According to another aspect of the present invention, a method of manufacturing lock-top canister bags is provided, which comprises the steps of:

extruding continuous dual parallel ribbons of semi-rigid plastic material having upper and lower edges and opposite side faces, with a zip-lock type fastener channel extending along each inside face, and a fold line spaced above each zip-lock type fastener;

die cutting of the upper edges of the extruded ribbons to form a series of indents extending through the fold lines separated by projecting flaps incorporating uncut portions of the fold lines;

welding the lower edges of the ribbons to the respective upper edges of continuous flexible film sheeting suitable for conversation to bag-like containers; and cutting and sealing the resulting construct into individual bag-like containers having seals on opposing sides which run perpendicular to the extruded ribbon top and a seal or fold line off the edge opposite the zip-lock type closure.

The die cutting step may use segmented perforation blades in order to provide lines of perforations defining the indents, with the portion of each strip above the lines of perforations forming a removable tear-off portion for later removal by a user. In this case, the upper edges of the two opposing ribbons may be sealed for tamper protection. This will provide evidence of any tampering. Alternatively, the die cutting may be performed by a continuous cutting blade so that the upper portions of the strips are removed prior to final assembly of the bag.

In an alternative method, rather than extruding two parallel ribbons, a single ribbon may be extruded or injection molded with a pair of spaced, parallel zip-lock type fastener channels on one, inner face on opposite sides of a center line, and a pair of parallel fold lines each positioned between a respective zip-lock fastener and the center line. The strip is then folded about the center line with the zip-lock fastener channels facing inwardly and aligned. The opposing halves of the strip may then be die cut with lines of perforations to define portions to be removed later. The edges of the folded strip can then be welded to flexible film sheeting and the resultant structure can be cut and heat sealed to form individual bags.

Where the container is for storing and dispensing household products or the like, the lower end of the bag is preferably formed with an inwardly folded gusset which can be flattened to form a support surface for holding the bag upright on a flat surface. If the container is for use in waste disposal, such as urine disposal, the lower end may be a straight sealed edge. In this case, the bag is preferably also formed with an internal funnel secured to the open end of the bag and extending inwardly into the bag, for conducting fluid from the open end of the bag into the bag. A gellable hydrophilic material is preferably also provided in the bag in this version, for absorbing fluids deposited in the bag.

The bag-like container of this invention has a strip around its open end which incorporates a closure for the bag, a stiffener which provides dynamic tensioning or hoop stress when the handle flap or tab is folded at least 90 degrees away from its original plane. The handle flap can be bent outwardly to function as a handle which can be gripped at a location spaced from the bag opening, and can be bent down to lock the bag open so it does not snap closed if accidentally released. The ability to lock the bag open allows products to be dispensed from the bag without requiring use of either hand to actually hold the bag open. The container is easy and inexpensive to manufacture, and the strip may be secured to any type of bag.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which:

FIGS. 11A–11F show steps in one method of making the container; and

DESCRIPTION OF THE PREFERRED EMBODIMENTS

Figure 1:
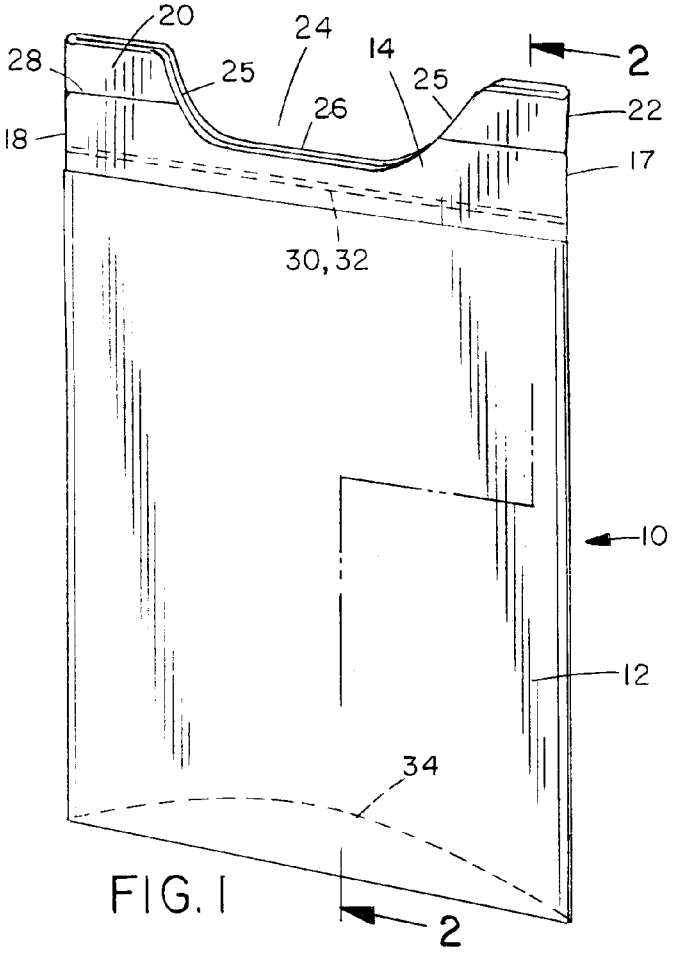
FIG. 1 is a perspective view of a lock-top canister bag according to a first embodiment of the invention in a closed position.

FIGS. 1 to 6 of the drawings illustrate a lock-top canister bag 10 according to a first embodiment of the present invention. The bag 10 basically comprises a bag portion 12 of flexible material such as plastic, and a closure device or bag top comprising opposing flat closure strips 14,15 secured along opposite sides of the open end 16 of the bag. Strips 14,15 are of a relatively stiff, but bendable material, such as semi-rigid plastic material.

The two closure strips 14,15 are preferably secured together at their opposite ends by seal or fold lines 17,18. The lower edges of the strips are suitably secured to the open end of the bag by heat sealing, welding, adhesive, or the like. Upwardly projecting flaps or tabs 20,22 are provided at opposite ends of the strips, separated from one another by an arcuate indentation or cut out 24 in each strip. The tabs are formed integrally with the closure strips. Each indentation has tapering end edges 25 extending from the top of the respective flap downwardly to the lower, straight edge 26 of the indentation. A fold line 28 of reduced thickness extends along each flap 20,22 at a location spaced below and parallel to the top of the flap.

Figure 2:
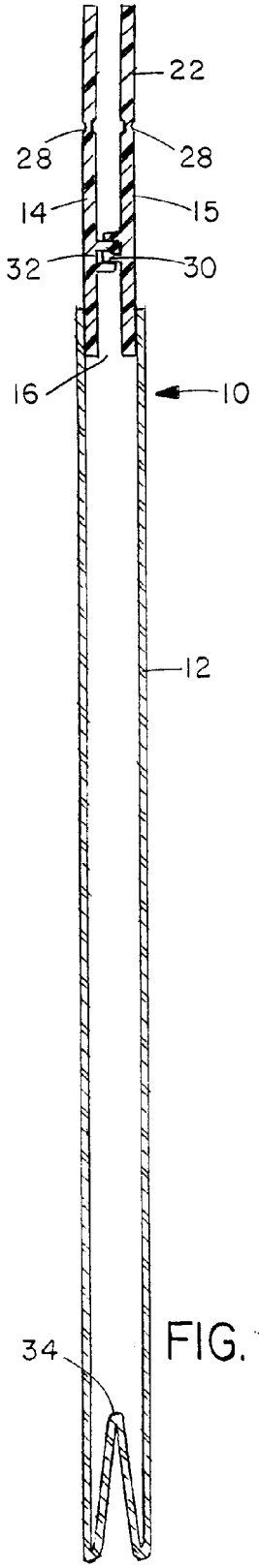
FIG. 2 is an enlarged sectional view taken on line 2—2 of FIG. 1.
Figure 3:
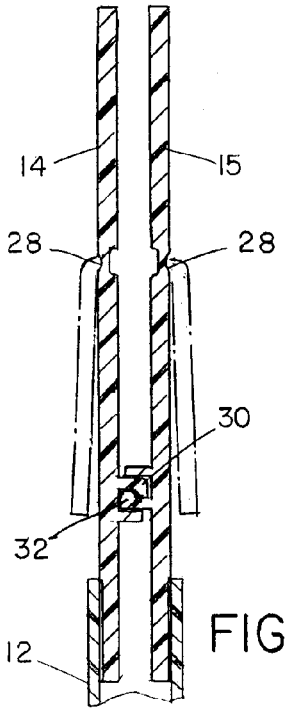
FIG. 3 is an enlargement of the upper portion of FIG. 2.

As best illustrated in FIGS. 2 and 3, the inner opposing faces of the strips 14,15 are each formed with an integral, snap lock fastener formation 30,32 extending along the length of the respective strip for releasable snap lock engagement with the formation on the opposing strip face. The fastener formations are preferably of the type known as a ZIPLOC® fastener. Such a fastener is formed by a rib at one side which snaps into a channel on the opposite side, as generally illustrated in FIGS. 2 and 3. The fastener formations are located adjacent the connection of the strips 14,15 with the open upper end of the bag and seal the bag closed when engaged as in FIGS. 2 and 3.

The closed lower end of the bag is preferably formed with an inwardly folded gusset 34, as best illustrated in FIGS. 1 and 3, in an accordion-like fashion. When the gusset 34 is extended by urging opposite sides of the bag outwardly as in FIG. 5, the lower end 35 of the bag assumes a generally flat configuration, so that it can be placed on a flat surface with the bag held upright.

When the bag is empty, it can be stored in a generally flat configuration as in FIGS. 1 and 2, with gusset 34 folded inwardly and the opposing stiffener strips pressed together with the opposing snap lock formations snapped into a closed and sealed condition. The bag is suitable for holding and storing many different products, including household and other products of a granular or liquid nature, for example. The contents of the bag are secured and sealed for storage purposes by means of the fastener formations 30,32 on the opposing fastener or stiffener strips 14,15. When some or all of the contents of the bag are to be dispensed, the fastener formations are released by pulling the opposing strips 30,32 apart, and opposite ends of the strips are urged inwardly at the fold lines 17 and 18, so that the strips flex outwardly as in FIG. 4 to form an opening. By folding the flaps or tabs 20,22 downwardly about the fold lines 28, as in FIG. 4, the bag is held in the open position and does not have to be held open by the user. It can therefore be placed on a suitable surface such as a counter top or table, leaving the contents of the bag readily accessible to the user. Thus, the user can easily spoon or scoop out the amount of product needed, reducing the risk of spills.

Figure 4:
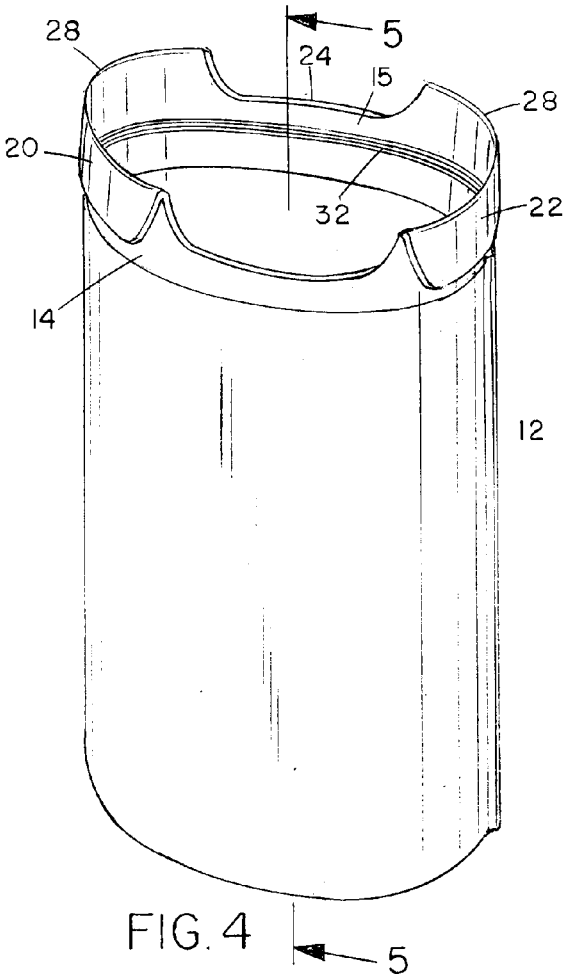
FIG. 4 is a perspective view of the bag in an open position.
Figure 5:
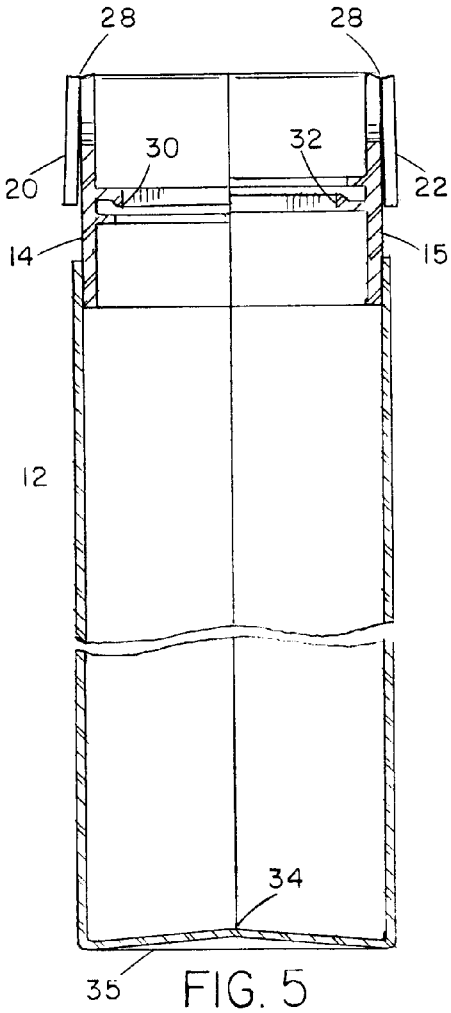
FIG. 5 is an enlarged sectional view taken on line 5—5 of FIG. 4.
Figure 6:
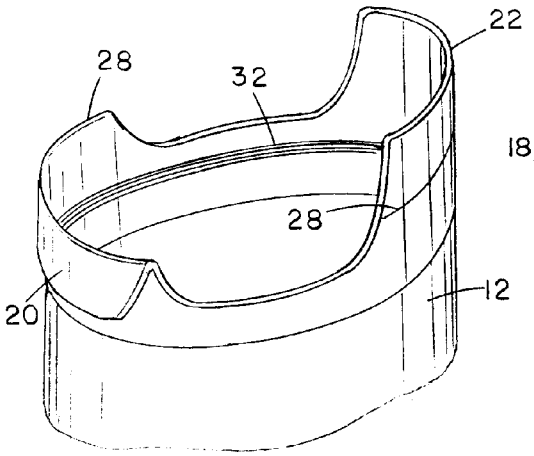
FIG. 6 is a perspective view showing one end of the lock top extended for use as a spout.

Alternatively, one or both flaps or tabs can be left extended to form a pour spot for dispensing product from the bag, as in FIG. 6, with the other flap folded down through 180 degrees as in FIG. 4, or folded through 90 degrees to extend outwardly from the bag opening. In the latter case, the folded flap can be used as a handle for holding the bag while pouring product out via the spout at the other end formed by the extended flap or tab as in FIG. 6. The bag in FIGS. 1 to 5 has two handle flaps or tabs, one at each end of the bag opening, but one of the flaps may be omitted in alternative embodiments.

The container may conveniently be used for holding and storing cooking ingredients such as flour, sugar, cake mix, pancake mix, and the like. Where it is used to contain cake mix, bread mix, or pancake mix, the container may also be used as a mixing device. Thus, the bag may be held open by releasing the snap lock fastener formations and urging opposite ends of the strips towards one another, and other ingredients such as oil, eggs, water or the like may be added to the dry contents of the bag. The bag is then re-sealed by urging the snap lock formations into releasable, snap-lock engagement. The bag can then be shaken and kneaded in order to mix the contents together to form a dough, pancake batter, or the like. This reduces soiling of kitchen utensils such as bowls and spoons.

Figure 7:
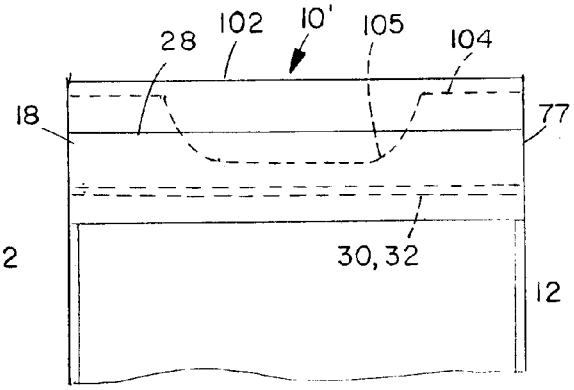
FIG. 7 is a partial front elevational view of the top end of a modified lock-top canister bag with tamper protection.

FIG. 7 illustrates a modified lock-top canister bag 10' with a tamper-evident top. The bag 10' is otherwise identical to that of FIGS. 1 to 6 and like reference numerals have been used for like parts as appropriate. In this embodiment, the two stiffener strips 14,15 are sealed together along an upper, straight edge 102 of the bag, after the bag has been filled with a product to be dispensed. A line of perforations 104 is formed along each strip 14,15, with an arcuate portion 105 crossing fold line 28. The user tears off the portions above the perforation lines 104, allowing the bag to be opened, and simultaneously forming the two end tabs 20,22 and arcuate indent 26 separating the tabs.

Figure 11D:
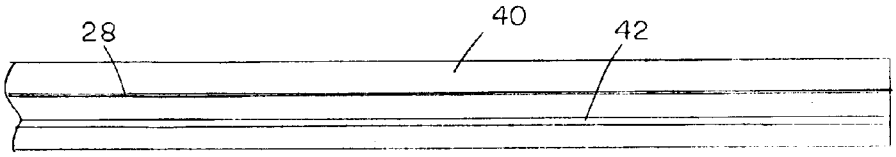
Figure 11D:
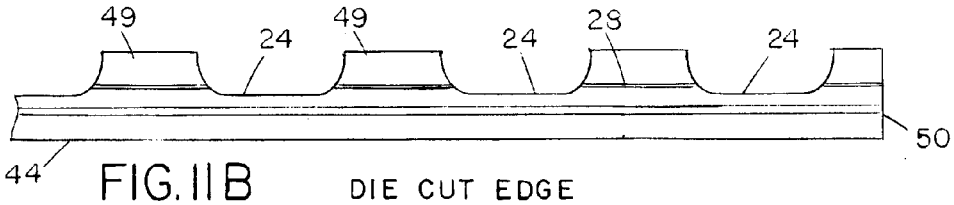
Figure 11D:
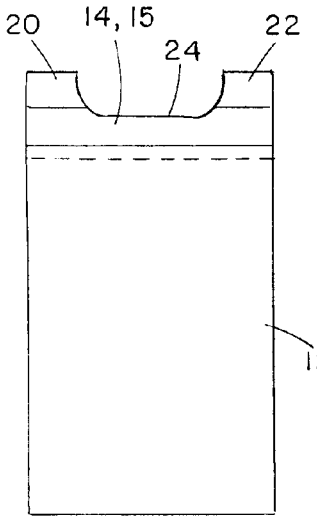

FIGS. 11A to 11F schematically illustrate a series of method steps for manufacturing the bag of FIGS. 1 to 5. Preferably, the closure strips are formed from dual extruded ribbons 40 with a snap lock formation or seal line 42 on one face formed parallel to and spaced from one edge 44 of the ribbon, as illustrated in FIG. 11A. A fold line or reduced thickness portion 28 is formed on the same face of the ribbon, parallel to and spaced above snap lock formation 42.

FIG. 11B illustrates the next step in the method, in which a series of arcuate cut-outs or indentations 24 are formed at spaced intervals along the upper edge 48 of the ribbons by die cutting to define spaced projecting tabs 49. The indentations extend through the fold lines 28 but terminate short of the snap lock formation 42. Alternatively, as indicated in FIG. 11C, a line of perforations 104 with arcuate portions 105 may be formed along each strip with perforation blades, spaced below an upper edge 102 of the strip. This alternative is used when tamper-evident bag 10' of FIG. 7 is to be made.

Figure 11E:
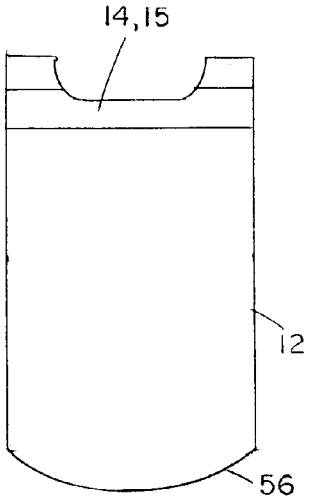
Figure 11F:
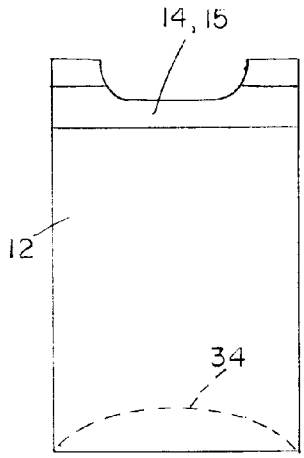

After the dual parallel ribbons are extruded and die cut or cut with perforations as in FIGS. 11B or 11C, the lower edges of the two ribbons are suitably welded to the upper edge of one continuous sheet of film with a fold at one end, or two separate film sheets, as in FIG. 11D. The resultant construction is then cut and sealed into individual bag like containers (FIG. 11E). If tamper evident bags 10' are to be manufactured, the upper edges 102 of the two strips will be sealed after filling each bag with the required quantity of product. Alternatively, the bag may be filled through the open lower end of the bag prior to sealing the lower end closed. The lower end of each bag may be die cut to form an arcuate extension 56, as in FIG. 11E, and sealed along the lower arcuate edge. This can then be folded inwardly to form gusset 34, as in FIG. 11F. Alternatively, the gusset may be formed from a completely separate piece of material welded across the open lower edge of each bag. This will be less expensive, particularly when the bag itself is formed from a relatively heavyweight plastic material.

Where the bags are filled through the upper, open end, the closure strips are subsequently passed between nip rollers in order to snap the zip lock formations into engagement. In the non tamper resistant version, the filled bags can then be suitably packaged for sale. In the tamper evident version of FIGS. 7 and 11C, the upper edges of the strips are then sealed together so that the bag is completely sealed above the perforated lines 104, and any attempt to tamper with the contents will be immediately evident to a user.

Figure 12:
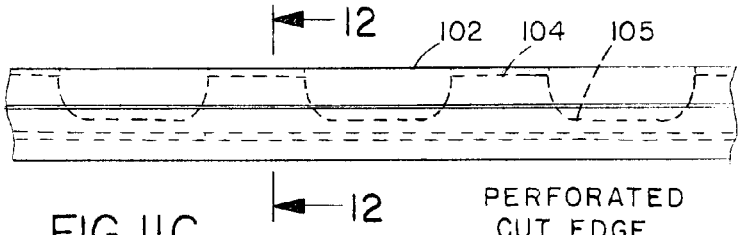
FIG. 12 illustrates a modified method step.
Figure 12:
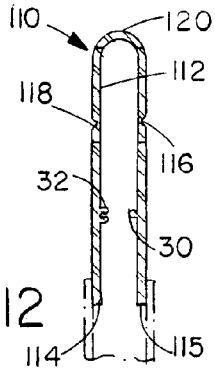

Instead of forming the upper closure device of the bag from two separate extruded ribbons, as in FIGS. 11A to 11C, the closure device may alternatively be formed from a single extruded or injection molded strip 110, as illustrated in FIG. 12. The strip 110 is formed with a pair of spaced, parallel zip-lock type fastener channels or formations 30,32 on one, inner face 112 of the strip, each formation 30,32 being spaced from a respective edge 114,115 of the strip on opposite sides of a center line of the strip. A pair of parallel fold lines 116,118 are each positioned between a respective zip-lock formation 30,32 and the center line of the strip which extends parallel to lines 116,118. The strip is then folded about central fold line 120 with the zip lock formations facing inwardly, as indicated in FIG. 12. At this point, the strip may be cut as indicated in FIG. 11B to form the bag opening, tabs, and arcuate indents, or lines of perforations 104 may be formed as in FIG. 11C in order to produce a tamper resistant bag. The opposite edges 114,115 of the folded strip are then welded to sheet material or film for forming the bag 12, as indicated in FIG. 12. The strip and attached sheet material are suitably cut and sealed to form the individual bags in an equivalent manner to that illustrated in FIGS. 11D to 11F.

Figure 8:
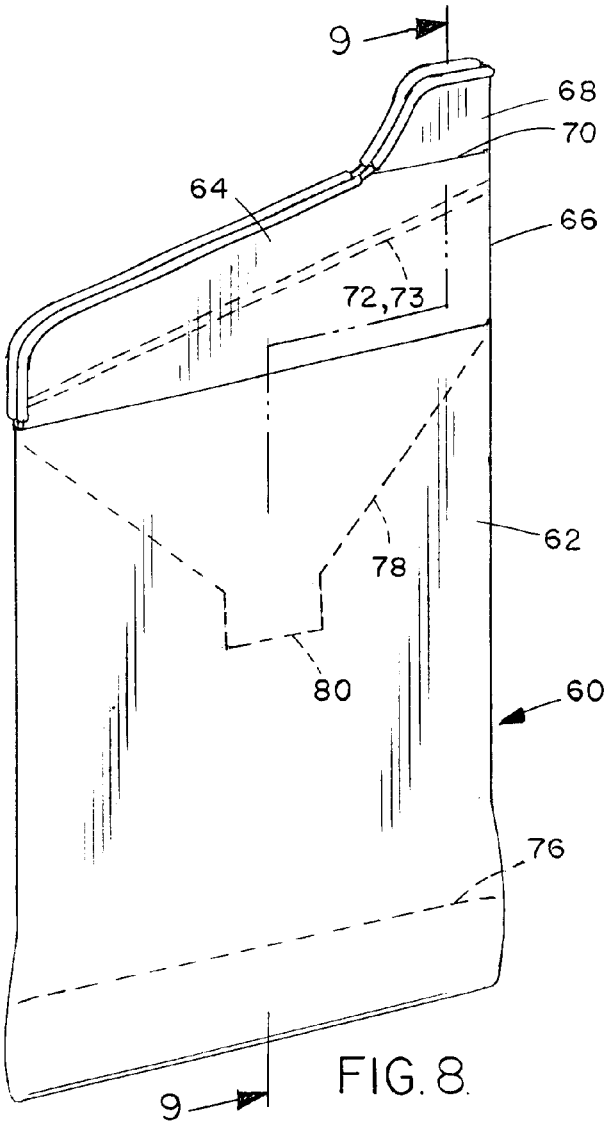
FIG. 8 is a perspective view of an alternative container configuration.
Figure 9:
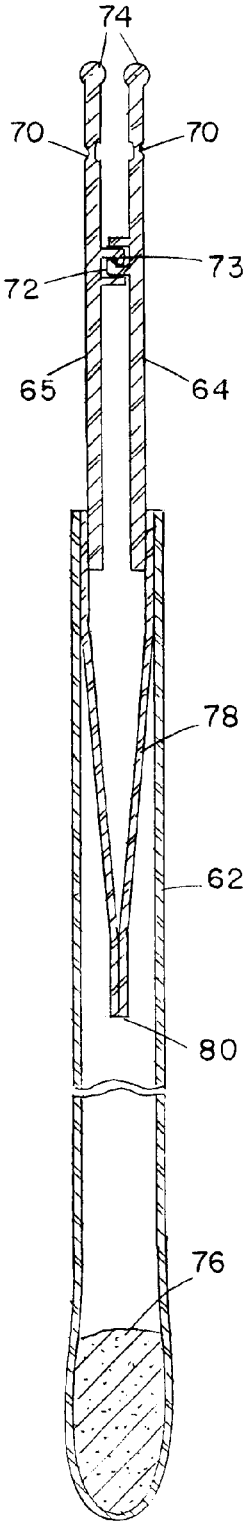
FIG. 9 is an enlarged sectional view taken on line 9—9 of FIG. 8.
Figure 10:
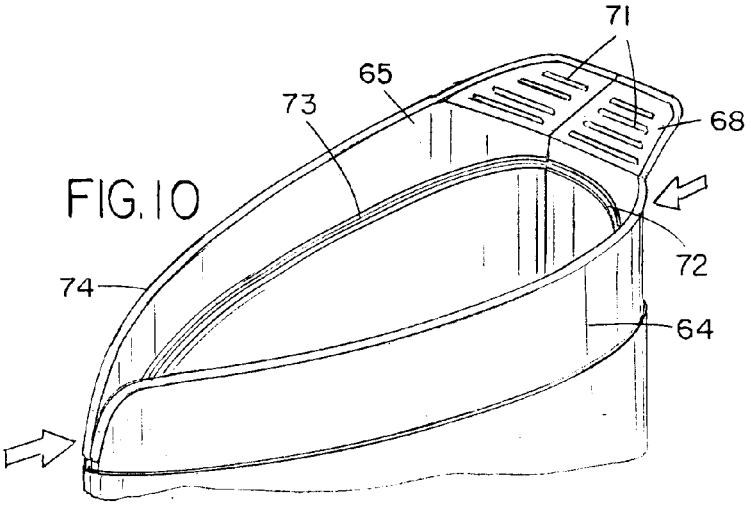
FIG. 10 is a perspective view showing the top of FIG. 8 held in an open position.

In FIGS. 1 to 7, a container 10,10' suitable for storing and dispensing products is described. FIGS. 8 to 10 illustrate a modified bag-like container 60 suitable for collecting and disposing of bodily fluids such as urine. The container 60 basically comprises a bag 62 of flexible, leak-proof material such as plastic, and a closure device similar to that of FIGS. 1 to 6 comprising opposing flat closure strips 64,65 secured along opposite sides of the open end 66 of the bag. Strips 64,65 are of a relatively stiff, but bendable material, such as semi-rigid plastic material.

The two single folded closure strips 64,65 are preferably formed integrally from a single injection molded ribbon of material, folded along a center line 66 prior to sealing to the upper edge of bag 62. The upper edges of the strips 64,65 are shaped to form an upwardly extending tab or handle 68 at one end only, with a fold line 70 separating tab 68 from the remainder of the two strips. Tab or handle 68 has ribs 71 on its inner face forming a gripping surface. As in the previous embodiment, opposing inwardly directed snap-lock grooves or formations 72,73 are formed along the inner faces of the two strips. Unlike the previous embodiments, formations 72,73 are not parallel to the upper open end of the bag, but are inclined upwardly from one end of the strips towards the fold line 66. The upper edges of the strips are formed with an enlarged strengthening bead 74. The lower edges of the strips are suitably secured to the open end of the bag by heat sealing, welding, adhesive, or the like.

The bag 62 is similar to the fluid containment bag described in U.S. Pat. No. 5,116,139, the contents of which are incorporated herein by reference. A liquid absorbing material 76 is enclosed within bag 62 at the lower end thereof, as best illustrated in FIG. 9. The material is a suitable hydrophilic gellable material which gels rapidly on contact with a liquid such as urine or blood. A funnel structure 78 is enclosed within the upper end of the bag, with the wider, open end of the funnel sealed to the upper end of the bag. Lower funnel opening 80 directs fluid into the interior of the bag. The funnel structure may alternatively comprise a membrane which is permeable to liquids, as described in co-pending application Ser. No. 09/206,616, now abandoned referred to above.

The container 60 provides a convenient, disposable travel or outdoor toilet, which has an integrally formed stiffened top which incorporates a handle 68. The container can readily be used for urine collection by both males and females when at a location where no bathroom facilities are available. In order to use the bag to collect urine, the snap lock fastener formations 72,73 are first released, and the top of the bag is opened by urging opposite ends of the strips 64,65 inwardly in the direction of the arrows in FIG. 10. This holds the funnel structure 78 open for receiving urine. At the same time, the upwardly projecting strips 64,65 act as a splash guard to reduce the risk of splashing. The tab or handle 68 has various functions. First, it can be bent down through 180 degrees about fold line 70 if desired, in which case it will lock the bag top open so that it does not snap closed if accidentally released. Alternatively, it can be bent through 90 degrees to extend outwardly from the bag top, as in FIG. 9. In this case, it can be used as a handle or grip so that the user does not have to touch or hold potentially contaminated surfaces. The upwardly inclined shape of the bag closure or top, up to tab 68, naturally orients the bag so that the open end can be held against the female anatomy as needed, with the bag hanging down vertically, again reducing the risk of leakage and ensuring that urine flow is directed into the bag. Thus, the bag 60 is equally convenient for use by both males and females.

After use of the bag, the top strips are re-sealed via snap lock formations 72,73 and the bag can be readily set aside or carried to a location for disposal, without risk of contamination. Although the bag is primarily intended as a urine collection device, it may alternatively be used for collection and disposal of other bodily fluids, such as vomit, or as a medical sample collection device.

Although some exemplary embodiments of the invention have been described above by way of example only, it will be understood by those skilled in the field that modifications may be made to the disclosed embodiments without departing from the scope of the invention, which is defined by the appended claims.

We claim:

1. A lockable bag-like container, comprising:

a bag of flexible material having a closed end and an open end;

a pair of opposing flat stiffener strips of stiffer material than the bag extending from the open end of the bag, the strips each having a lower edge secured to the open end of the bag, an upper edge, opposite first and second ends, and opposite inner and outer faces, and the strips being joined together at least at their first ends;

a closure device formed on the inner face of each strip for releasably closing the open end of the bag; and a handle flap extending upwardly from the upper edge of the strips at least at one end of the strips, the handle flap being integrally formed with the strips and having a fold line joining the handle flap to the strips, whereby the bag can be held open by urging opposite ends of the strips towards each other, and the handle flap can be bent downwardly about the fold line to secure the bag in an open condition.

2. The container as claimed in claim 1, wherein the closure device comprises opposing snap lock fastener formations formed in opposing inner portions of the strips.

3. The container as claimed in claim 1, wherein the strips are formed integrally from a single ribbon of material and an integral fold line joins the first ends of the strips together.

4. The container as claimed in claim 3, wherein the handle flap extends across the fold line.

5. The container as claimed in claim 4, wherein the handle flap is shaped to form a pouring spout for pouring product from the bag when the bag is held open.

6. The container as claimed in claim 1, wherein a second handle flap projects upwardly from the second ends of the strips, the second handle flap having a fold line joining the flap to the strips.

7. The container as claimed in claim 1, wherein the bag has an inwardly folded gusset at its lower end which can be folded out when the bag is opened to form a generally flat lower end of the bag.

8. The container as claimed in claim 1, including a funnel inside the bag having an upper end secured to the open end of the bag, the funnel being of conical shape for directing fluid into the bag. material within said bag.

9. The container as claimed in claim 8, including a gellable hydrophilic material within said bag.

10. The container as claimed in claim 1, wherein the upper edges of the strips are inclined generally upwardly from the second end towards the handle tab at the first ends of the strips.

11. The container as claimed in claim 1, wherein each strip has an enlarged bead extending along its upper edge.

12. The container as claimed in claim 1, wherein the handle tab has an inner face with a plurality of raised ribs forming a gripping surface when the tab is used as a handle for holding the bag in an open condition.

13. The container as claimed in claim 1, wherein the stiffener strips, closure device, and handle flap are all formed integrally from a single ribbon of material.

14. the container as claimed in claim 1, wherein the stiffener strips are formed from two separate ribbons of material sealed together at opposite ends.

15. The container as claimed in claim 1, wherein the bag is filled with a product to be dispensed from the bag.

* * * * *

UNITED STATES PATENT AND TRADEMARK OFFICE

CERTIFICATE OF CORRECTION

PATENT NO. : 6,345,911 B1
DATED : February 12, 2002
INVENTOR(S) : Young, Daniel L. et al.

It is certified that error appears in the above-identified patent and that said Letters Patent is hereby corrected as shown below:

Column 8,
Line 30, delete "material within said bag."
Line 46, change "the" to -- The --.

Signed and Sealed this

Eighteenth Day of June, 2002

*Attest:*

*Attesting Officer*

JAMES E. ROGAN
*Director of the United States Patent and Trademark Office*